United States Patent [19]

Molitor

[11] 4,125,148

[45] Nov. 14, 1978

[54] METHOD FOR UTILIZATION OF WASTE ENERGY

[75] Inventor: Victor D. Molitor, Denver, Colo.

[73] Assignee: Stainless Equipment Company, Englewood, Colo.

[21] Appl. No.: 789,938

[22] Filed: Apr. 22, 1977

Related U.S. Application Data

[63] Continuation-in-part of Ser. No. 647,205, Jan. 7, 1976, abandoned.

[51] Int. Cl.[2] ..... F23J 11/00; F24C 15/20; F25B 29/00; F28F 27/02

[52] U.S. Cl. ..... 165/2; 55/222; 55/228; 55/256; 55/DIG. 36; 126/299 E; 165/27; 165/60; 165/61; 165/DIG. 2; 237/52; 237/55; 261/128; 261/150; 261/151; 165/107 R

[58] Field of Search ..... 55/222, 228, 255, 256, 55/DIG. 36; 261/150, 151, 128, 158, 159; 165/1, 2, 27, 59, 60, 61, 101, 106, 107, DIG. 2, DIG. 12; 126/299 D, 299 E, 299 F; 237/52, 55

[56] References Cited

U.S. PATENT DOCUMENTS

| | | | |
|---|---|---|---|
| 3,018,231 | 1/1962 | Valentine et al. | 55/228 |
| 3,169,575 | 2/1965 | Engalitcheff, Jr. et al. | 165/60 |
| 3,276,514 | 10/1966 | Leonard, Jr. | 165/27 |
| 3,473,298 | 10/1969 | Berman | 55/222 |
| 3,507,322 | 4/1970 | Tetrick et al. | 165/61 |
| 3,661,366 | 5/1972 | Shinkle | 55/228 |
| 3,786,739 | 1/1974 | Wright | 55/DIG. 36 |
| 3,813,856 | 6/1974 | Jensen | 55/DIG. 36 |
| 3,841,062 | 10/1974 | Molitor et al. | 126/299 |
| 3,854,388 | 12/1974 | King | 55/DIG. 36 |
| 3,892,825 | 7/1975 | Nazzer | 261/151 |
| 3,927,153 | 12/1975 | Tarhan | 261/151 |
| 3,967,940 | 7/1976 | Hirano et al. | 55/222 |
| 3,968,833 | 7/1976 | Strindehag et al. | 165/59 |
| 3,972,678 | 8/1976 | Nakshbendi | 55/228 |
| 4,011,802 | 3/1977 | Molitor et al. | 55/DIG. 36 |
| 4,020,895 | 5/1977 | Schafer | 165/61 |
| 4,032,421 | 6/1977 | Fabricius | 55/228 |
| 4,043,319 | 8/1977 | Jensen | 126/299 D |

OTHER PUBLICATIONS

Aero Heat Exchanger, Niagara Blower Company, Bulletin #161, 9-12-73.

Performance of a Novel Sub-X Heat Exchanger, Huckaba and Master and Santoleri, Chemical Engineering Progress, vol. 63, No. 7, 7-67.

*Primary Examiner*—Charles J. Myhre
*Assistant Examiner*—Sheldon Richter
*Attorney, Agent, or Firm*—Horace B. Van Valkenburgh; Frank C. Lowe

[57] ABSTRACT

A gaseous source of waste energy, including heat, is passed through a gas to liquid heat exchanger and then a chiller to agitate a water bath and produce evaporation of water for cooling. The heated transfer liquid is passed through a heat exchanger to heat makeup air or the like, while, alternatively, chilled water from the chiller is passed through the heat exchanger to cool the makeup air. Supplemental heating, as by a furnace, or supplemental cooling, as by refrigeration, may be utilized when called for.

Separate heat exchangers, as for separate areas, are alternatively supplied with heated transfer liquid or chilled water, or one or more supplied with heated transfer liquid and one or more others supplied with chilled water.

The source of waste energy, including heat, is normally fumes and heated air from cooking equipment passed through a grease extraction ventilator. Such a grease extraction ventilator may include water contact means, the water of which may be circulated through the heat exchanger when cooling only, by circulating cooled water produced by the chiller, is desired. Other sources of waste energy may be suitable, such as heated air which has risen to the upper portion of a large room or enclosure, such as an auditorium, theater, meeting hall or the like. The heated air removed from such a position is adapted in part to be recirculated, but all of it may be used to furnish heat for heating fresh makeup air. Two forms of a specialized double compartment chiller are disclosed, as well as alternate ways of returning circulated water back to the chiller.

12 Claims, 7 Drawing Figures

METHOD FOR UTILIZATION OF WASTE ENERGY

This application is a continuation-in-part of my copending application Ser. No. 647,205 filed Jan. 7, 1976, now abandoned.

This invention relates to a method for waste energy utilization, and more particularly to the heating of air by waste energy and the alternative chilling of water for cooling additional air.

With respect to the latter, numerous types of air treatment devices have been devised. In some types, generally known as the "swamp cooler" type, water is dripped into an air stream or contacted by the air by passing through a water absorbent pad. The air will cause a portion of the water to evaporate, thereby lowering the temperature of the air and the water, due to the number of b.t.u. required to equal the latent heat of evaporation of the water. For such cooling, the air normally should be relatively dry, since such a "swamp cooler" does not operate with real effectiveness when the relative humidity of the incoming air is excessive, such as over 50%. Thus, the so-called "swamp cooler" is particularly adapted for use at locations at which the relative humidity of the air is low but in the summertime when cooling is needed most. Obviously, cooled air having a relative humidity of 100% furnished to a room normally produces discomfort to humans in the room.

Among the objects of this invention are to provide a method of waste energy utilization in which waste air may be passed into intimate contact with water accomplished with a relative minimum of complexity and expense; to provide such method in which a flow of water may be proportioned to the volume of air such that not only is the air cooled, but the water is cooled and may be drawn off for heat exchange with additional air, this feature being particularly applicable to situations in which the initial air is objectionable for use as incoming air for the same or a different room. Such a situation may occur where the resulting air has an unacceptably high humidity or contains smoke or other products of cooking and the like, or is contaminated for any other reason.

Another object of this invention is to provide such a method in which separate water baths may be contacted by different waste air flows, in order to chill makeup air at successively lower temperatures.

Further objects of this invention are to provide such a method associated with a source of heated waste air, such as cooking equipment, and in which the air, after passage in contact with water, as in a grease extraction ventilator of my U.S. Pat. No. 3,841,062 to strip the air of grease and other products of cooking, is passed through a heat exchanger to heat water or liquid passed therethrough. This heated water is used in a heating system when the outside temperature is lower than the temperature to be maintained inside, but alternatively, when the outside temperature is higher than the predetermined temperature to be maintained inside, this same air, after passage through the heat exchanger, is passed against a water bath to evaporate a portion of the water and chill the water. The chilled water may then be supplied to one or more heat exchangers to cool air for passage into the room or other area to be cooled. These latter heat exchangers may be positioned at a remote location, even on a roof.

The manner in which the foregoing objects are attained, as well as other objects and the novel features of this invention, will become apparent from the description which follows, taken in conjunction with the accompanying drawings, in which.

Figure 3:
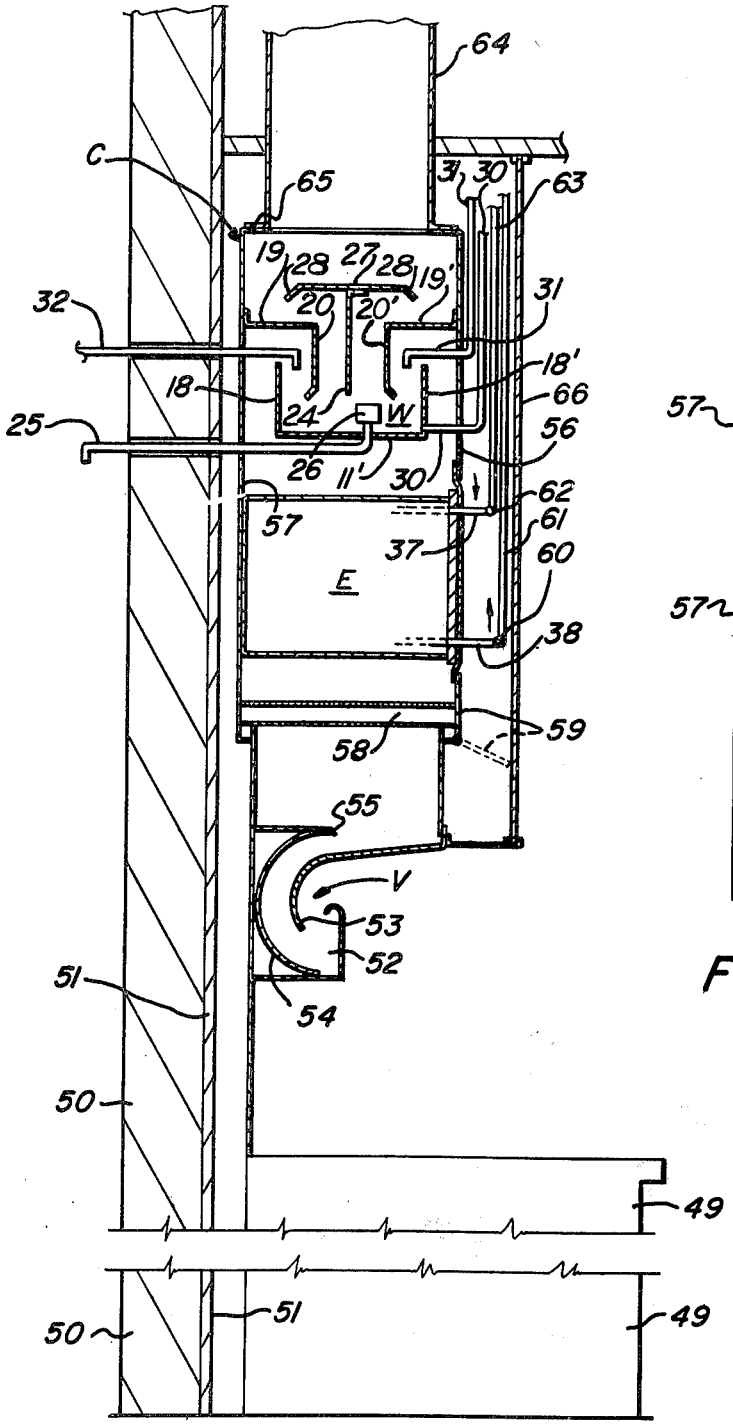

FIG. 3 is a diagrammatic, central vertical section of a grease extraction ventilator mounted over cooking equipment, with flow of the waste air, after grease extraction, through a heat exchanger for producing warmed water for heating use on cold days and, alternatively, passage of the waste air, after grese extraction, through a water chiller, to produce chilled water for air cooling on warm or hot days.

Figure 4:
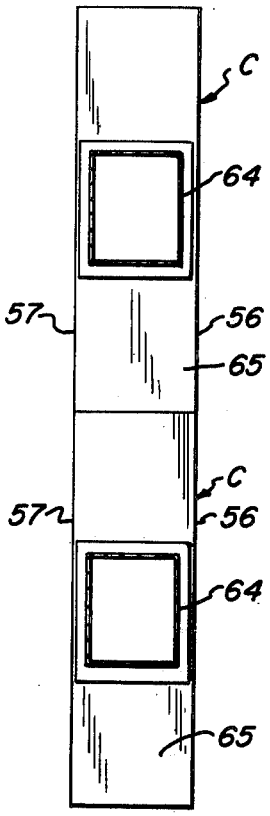

FIG. 4 is a top plan view, on a reduced scale, of the equipmenT OF FIG. 3.

Figure 5:
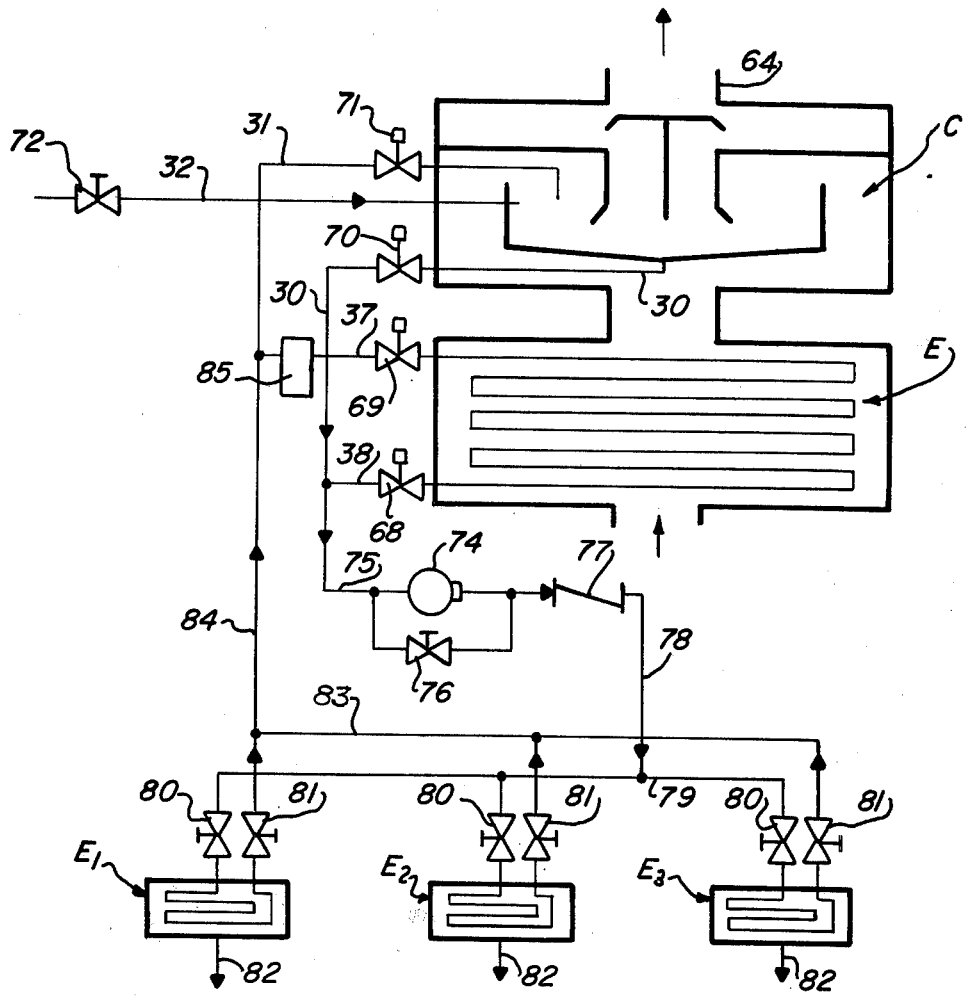

FIG. 5 is a schematic flow diagram showing the flow control devices utilized with the alternative heater and chiller of FIG. 3 and the makeup air heat transfer units.

Figures 6, 7:
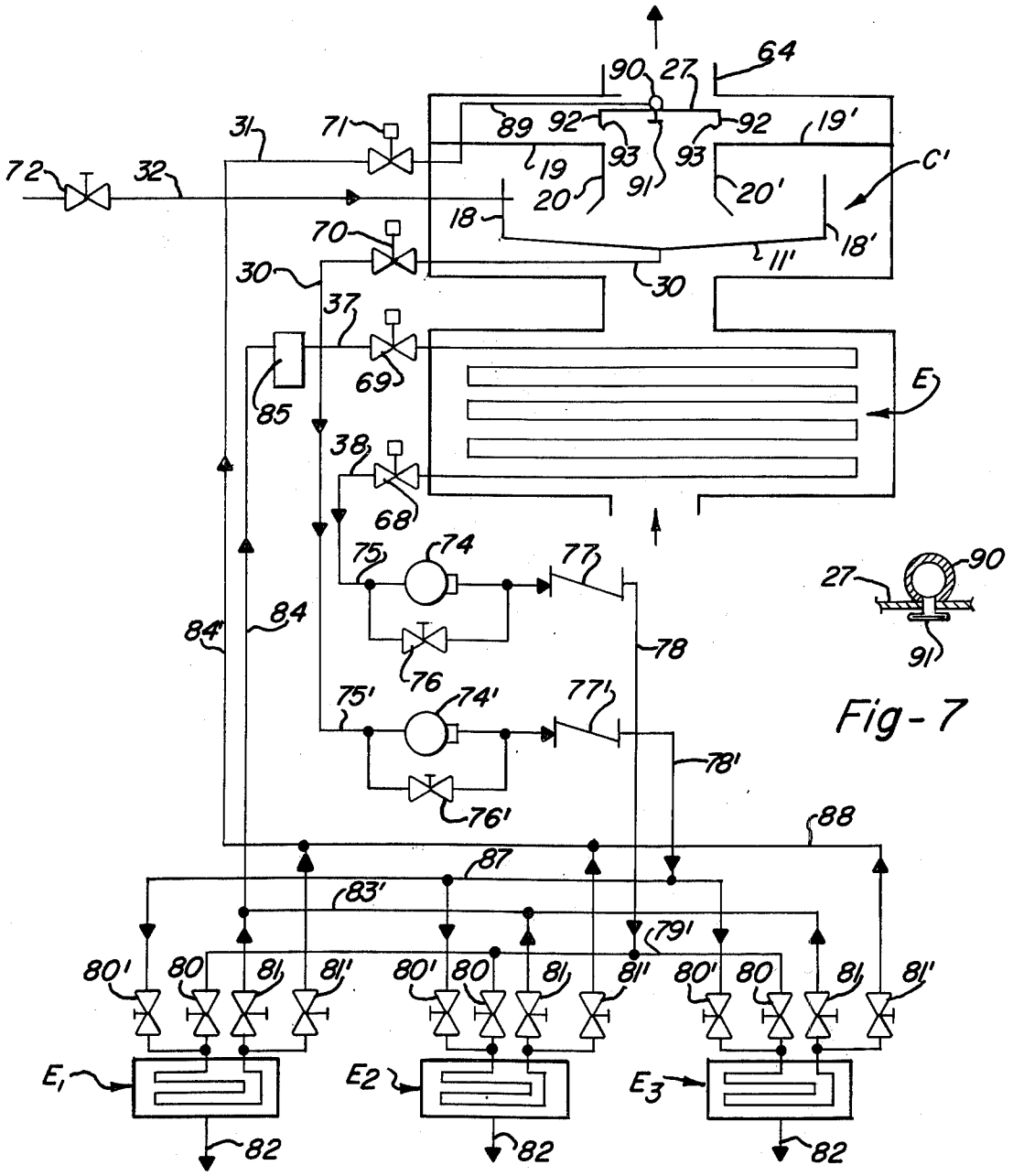

FIG. 6 is a similar schematic flow diagram showing an alternative arrangement in which individual makeup air heat exchange units may be supplied alternatively with a heating or cooling liquid and also showing an alternative return flow arrangement for the chiller.

FIG. 7 is a fragmentary section, illustrating a return flow baffle and nozzle arrangement shown diagrammatically in FIG. 6.

Figure 1:
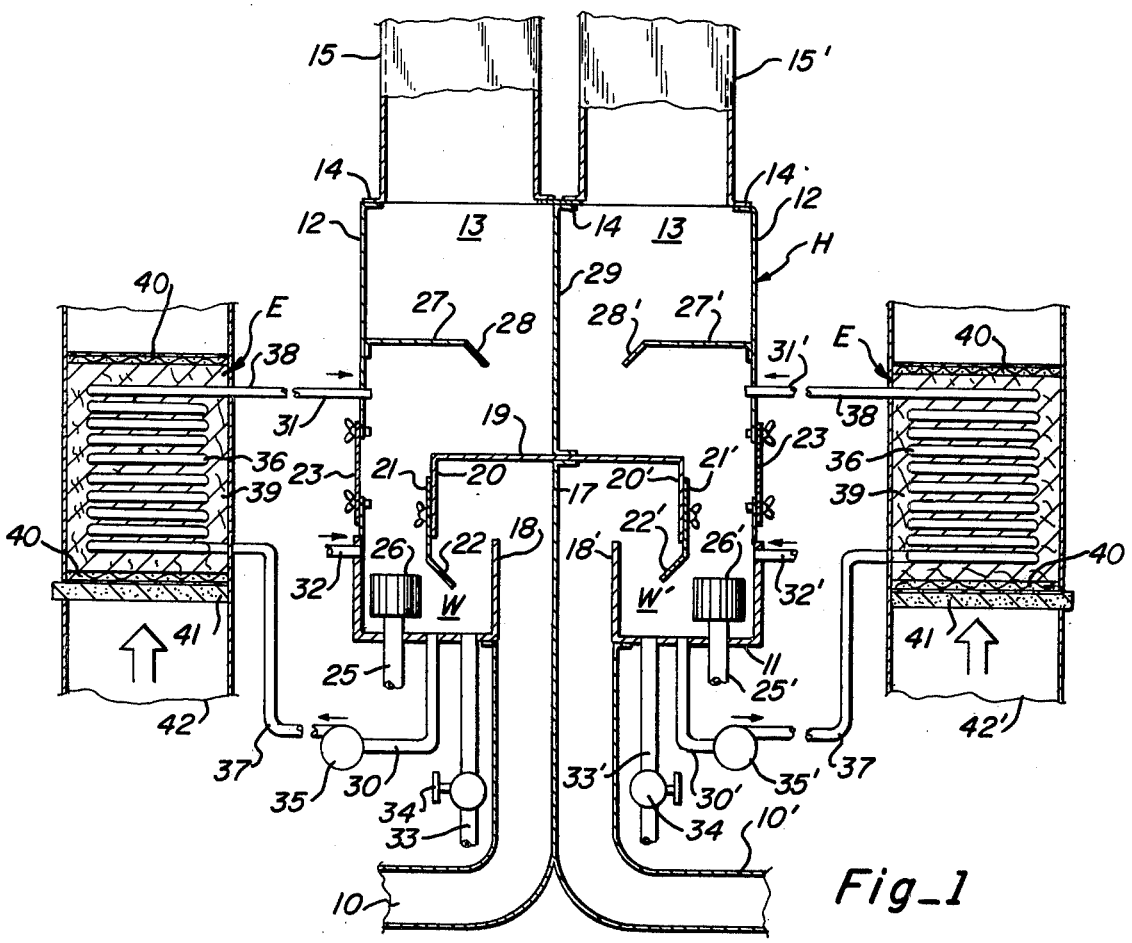
FIG. 1 is a diagrammatic, central vertical section of a waste air water chiller in which separate supplies of air are passed against individual water baths and used or exhausted separately, while the water chilled by the flow of air is, in each instance, passed through a separate heat exchanger for cooling air from another source.

In the waste air water chiller of FIG. 1, a housing H encloses a pair of separate water bath chambers W and W′ which have individual liquid supplies and individual waste air supplies through inlet ducts 10 and 10′, which are connected to a suitable aperture in a bottom plate 11 of the housing. The housing also includes side walls 12, end walls 13 and a top wall 14, the latter having apertures for attachment of a pair of exhaust ducts 15 and 15′. Extending between the end walls and centrally spaced to form a divider between ducts 10 and 10′ is a vertical plate 17, while an upright wall 18 and 18′ is spaced from each side of plate 17. Air at each side flows over the upper edge of the respective wall 18, 18′, while spaced above these walls is a horizontal plate 19 mounted atop divider 17 and extending between the end plates of the housing. At each edge, plate 19 has a depending flange 20 or 20′ on which is adjustably mounted an angular baffle 21 or 21′ which has a flange 22 or 22′ extending downwardly toward the respective wall 18 or 18′. Plate 19, flange 20, 20′ and flange 22, 22′ force the air to flow between wall 18, 18′ and the lower edge of flange 22, 22′. The elevation of the lower edge of flange 22 and 22′ is adjusted so that, with the particular volume of air flowing, the air will engage the upper surface of the water of the water bath and drive it upwardly and away from flange 22, 22′ for impingement against the respective side wall 12 of the housing. A pair of removable plates 23 permit access to the respective baffle 21 or 21′ for adjustment. An upright pipe 25 or 25′ is respectively provided with a drain cap 26 or 26′ at its upper end, in order to maintain the depth of water in the respective water bath at an appropriate level.

After passage upwardly from the water bath, the air at each side encounters a transverse baffle 27 or 27' mounted on and extending inwardly from the respective side wall 12, each having a downwardly sloping flange 28 or 28' around which the air passes. In doing so, the air is subjected to a stripping action which removes water droplets from the air, not only through the action of the flanges 28 or 28' per se, but also through the turning of the air around the flanges, so that water droplets are thrown out due to centrifugal force. From the upper end of the housing H, the cooled air, i.e. cooled by evaporation of water, proceeds upwardly on each side of a central partition 29 to an exhaust duct 15 or 15' for use as conditioned air in the same or another room, or merely discard. Flow through exhaust duct 15 or 15' may be occasioned by a conventional type of suction fan (not shown) in the duct beyond the extent shown in the drawing.

In addition to the use of the resulting air as an air conditioning agent, or the cooling of additional liquid by passage of the cooled air through a heat exchanger, additional liquid, i.e. from the water bath, is available for additional cooling of the gas, such as air. Thus, cooled water from the respective water baths W and W' may be withdrawn through a pipe 30 or 30' and returned through a pipe 31 or 31', respectively. Cooled fluid thus withdrawn may be utilized in a heat exchanger E, described below, for cooling additional air. If necessary, makeup water may be supplied through a pipe 32 or 32', while either water bath may be drained by a drain pipe 33 or 33' connected at the bottom of the respective water baths, with flow therethrough being controlled by a valve 34. In normal operation, the drain valve 34 is closed.

In the event that air flowing through either exhaust duct 15 is to be discarded because it is not usable, such as through an excessive humidity, it may be desirable to utilize the cooled air to cool water or other heat exchange liquid. Since the waste air received through inlet ducts 10 and 10' is normally from different sources and, after passage through the chiller, may be disposed of in different ways, it is also normal that the water cooled by the respective water baths W and W' will be cooled to different temperatures. Thus, effectiveness in cooling will be enhanced by passing makeup air first through the warmer heat exchanger E and then through the cooler one. In addition, the air which has passed through water bath W and the air which has passed through water bath W' may have compatible properties, such that a mixture of such air, even though at slightly different temperatures and at slightly different relative humidities, would, nevertheless, be capable of producing a desired cooling effect, when introduced into a particular room, without producing discomfort to persons in that room.

The advantage of the dual water bath for dual air streams which may be utilized as inflowing air for cooling the same or a different room or exhausted to the atmosphere, is pronounced, when the air supply to one duct, such as duct 10, is taken from the area above a dishwasher, for instance, which will tend to produce heated air with a high humidity. The air supplied through the duct 10' may also be taken from an area near the dishwasher, such as below the dishwasher, in which event the air may be cooler and have a lesser humidity. By passing the high humidity air through one water bath and the other supply of air through the other water bath, considerable flexibility in the arrangement may be obtained. Cold water outlet 30 or 30' is connected to a pump 35 or 35', respectively.

Each heat exchanger E is conveniently of the type described in my copending application Ser. No. 621,284 filed Oct. 10, 1975, now U.S. Pat. No. 4,075,935 i.e. having a series of coils 36 through which the liquid to be cooled is passed from an inlet 37 to an outlet 38, with each inlet 37 being connected to pump 35 or 35'. The coils 36 are initially formed in an axially spaced position, then a stack 39 of loosely woven cloth of copper or the like is placed between the adjacent coils and the central spaces within and outer spaces without the coil turns. The coil assembly is then compressed until the copper cloth 39 has been deformed to provide contact with the surfaces of the coils and thus have a greater propensity for the flow of heat between the fibers or threads of the copper cloth and the coils. The compressed copper cloth is maintained under pressure by the coils 36 and also by a screen 40 at each end. A conventional filter 41 may be placed across the entrance of the heat exchanger E, in order to prevent any particulate material from lodging within the compressed cloth of the heat exchanger.

The respective heat exchangers E are mounted in ducts 42 and 42'. If desired, and probably utilized more often, the chilled water outlet pipes 30 and 30' may be connected to upper ends of the respective coil 36, with the lower end of the coil connected to return pipe 31 and 31', respectively, to provide countercurrent flow in each of the respective heat exchangers. In addition, the cooled water flowing through pipe 30 may be led to the incoming water pipe 31' for the water bath W', the water bath W thus being utilized as a pre-cooler for the water bath W'. The then chilled water from water bath W' may be circulated from pipe 30' through a heat exchanger to chill additional air or the same air which has been initially chilled by heat exchange in the duct. The water exhausted from this heat exchanger may be introduced into the water bath W through pipe 31. In this way, the maximum cooling effect from the energy available may be obtained.

It will be understood, of course, that the air supplied through duct 10 to water bath W may have sufficient humidity that, after engagement with the water bath, the humidity will be so high that the air should not be used for direct introduction into a room. However, this does not mean that, when initially introduced through duct 10 or 10', for instance, the air is not able to pick up sufficient moisture to produce a cooling effect, but normally to the contrary, since heated air having the same number of grains of moisture per pound of dry air, has a lower humidity than air at a lower temperature. Thus, the heated air, such as taken from above a dishwasher, for instance, although containing a considerable amount of moisture, will still be able to pick up additional moisture, even to the point of saturation, and lower the temperature of the water bath against which it is directed.

Figure 2:
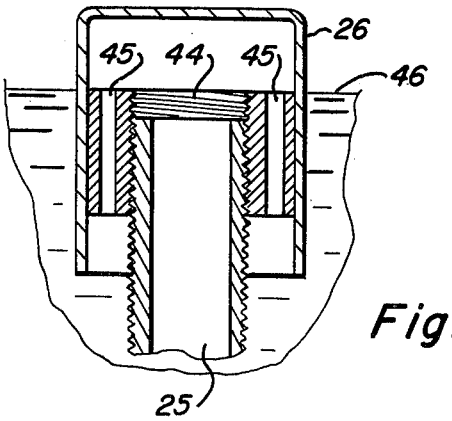
FIG. 2 is a vertical section, on an enlarged scale, of a drain pipe and an overflow cap utilized in the water baths of FIG. 1.

One possible construction of the drain cap 26 for the overflow pipe 25, as illustrated in FIG. 2, includes an inwardly extending boss 44, threaded on the inside so as to be adjustable upwardly and downwardly on pipe 25 and provided with an annular series of vertical holes 45 through which water may flow for discharge, in the event the water level 46 exceeds the top of boss 44. Ordinarily, the water level will be sloping, due to the impingement of air on the water, so that the drainage level will be a composite of the various levels around the cap. Normally, the water level 46 is maintained level with the upper edge of boss 44, as shown, so that no outflow will occur until the water level becomes higher. Although the surge and flow of the water, under the influence of the air stream, will cause the level 46 to fluctuate slightly, a generally average level will be maintained, since the water contour in front of pipe 25 may be lower than the level 46 and the water contour rearwardly of pipe 25, i.e. toward the corresponding side wall 12' may extend upwardly and above the level 46.

The apparatus of FIG. 3 is adapted to take advantage of the heat contained in air which is removed from above cooking equipment 49, such as a grill or stove, and which is then passed through a grease extraction ventilator having water contact means, as of the type of my U.S. Pat. No. 3,841,062, in which the air is passed against a water bath with a sufficient velocity to cause turbulence of the water, and stripping of the grease, smoke and other products of cooking equipment, except perhaps carbon monoxide and toxic gases. The cooking equipment and grease extraction ventilator V are mounted in front of a wall 50 having an insulating layer 51 to reduce the fire hazard. In flowing through ventilator V, the air is forced to engage water in a space 52 by movement around the forward, lower edge of baffle 53, so as to force the water against a curved rear plate 54, then pass around a baffle flange 55, for a purpose similar to that of flange 28 on baffle 27 of FIG. 1. After passage through the grease extraction ventilator V, waste air is passed through a rough filter 58, such as formed of fiberglass, access to which is obtained through a door 59, which may be tipped downwardly to the dotted position, for that purpose. This air still retains heat from that produced by the cooking equipment and is passed through a heat exchanger E, such as similar to that previously described, with pipe coils and compression against copper cloth and the like, or any other appropriate construction. This heat exchanger is provided with an inlet pipe 37 and an outlet pipe 38 for a heat transfer fluid, such as water. By flowing through the heat exchanger, the still heated air heats the fluid supplied by inlet 37 and flowing from the outlet pipe 38 for countercurrent flow. The heated water or other fluid, from outlet pipe 38, is supplied to an air heater which may be similar to heat exchanger E but in which air for air conditioning purposes is heated by flow therethrough and then transmitted to the room or area to be heated. It will be understood, of course, that the air rising from the cooking equipment 49 would pass through ventilator V and may be contaminated by cooking odors or the like, which may prevent it from being used as air ultimately supplied to a room or enclosure.

When cooling is called for, the waste air may still flow through the heat exchanger E for cooling the air prior to flow through a chiller C to which water is supplied for evaporation and resultant cooling. The heat exchanger E and chiller C are installed within a passage having a front wall 56 and a rear wall 57, with appropriate end walls. The width of the front and rear walls depends upon the width of the cooking equipment and the corresponding number of heat exchangers E and chillers C. With two chillers C, as in FIG. 4, above two grease extraction ventilators V, and on the order of four to six heat exchangers E beneath each chiller C, the outlet 38 of each heat exchanger may be connected to a manifold 60 which connects with a warm water supply pipe 61. Similarly, return pipes 37 are connected to a header 62 which connects with a return pipe 63, the pipes 37 and 38, for instance, being connected to manifolds for operation of several heat exchangers in parallel.

The chiller C is similar in function to the chiller of FIG. 1, except for a single inlet and outlet for the same waste air and same discharge air and a common water bath. The waste air flows to each side of a bottom wall 11', being forced by baffles 19 and 19' to flow over upright walls 18 and 18' and into the water bath W. Transverse plates 19 and 19' are provided with depending baffles 20, 20', each of which extends toward the corresponding wall 18 or 18' at the lower edge. Thus, the water is driven from each side against a central partition 24, with the air then passing upwardly on opposite sides of partition 24 to the underside of a transverse baffle 27 and around the downwardly extending flanges 28 at each side thereof. The air then passes through a discharge duct 64, which is connected with top 65 of the chiller, as also shown in FIG. 4. The chilled water flows through pipe 30 from adjacent the bottom 17 of the water bath or reservoir to a remote heat exchanger, being returned through the return inlet pipe 31. As before, water makeup pipe 32 extends to a position above the water bath W, while an overflow pipe 25 extends to a position centrally of the water bath and within a cap 26, to maintain the desired level therein. The front of the apparatus is closed by a removable panel 66.

The apparatus of FIG. 3 is further adapted to carry out a method of this invention, in which the gases exhausted from a cooking or similar area are used not only to save heat energy, but also to save fan or blower energy. Thus, the passage of such exhaust gases through a grease extraction ventilator V, a gas to liquid heat exchanger and a water evaporative chiller C not only cleans the exhaust gases but extracts heat therefrom for heating purposes, with a consequent saving of heat energy, as well as cooling the exhaust gases to minimize heat pollution effects. In the chiller, the exhaust gas is cooled at the same time that the water is chilled by evaporation, so that, again, the exhaust gases are cooled to reduce the heat pollution effect thereof, while refrigeration of room makeup air is obtained at very little additional operating cost. As indicated previously, during cooling the waste air from the grease extraction ventilator V is passed through the heat exchanger E for precooling prior to passage through the chiller C. The heat so recovered may be used to preheat water for a hot water heater, while the water for heat exchanger E may be circulated from grease extraction ventilator V for precooling the exhaust air prior to passage through chiller C, to increase the total cooling effect, particularly when the wet bulb temperature of the air is not reached in the chiller C.

In FIG. 5 are shown three heat exchangers $E_1$, $E_2$ and $E_3$, each of which is adapted to receive alternatively either heating water from the heat exchanger E or cooling water from the chiller C of FIG. 3. For controlling the flow of heated water to the heat exchangers $E_1$, $E_2$ and $E_3$, a valve 68 is placed in the heated water supply pipe 38 and a valve 69 in the heated water return pipe 37. Similarly, a valve 70 is placed in the chilled water outlet pipe 30 and a valve 71 in the chilled water return pipe 31. Also a metering valve 72 is provided in the makeup supply line 32.

A pump 74 is supplied by an inlet pipe 75 to which heated water pipe 38 and chilled water pipe 30 are each connected. A bypass pump flow valve 76 permits the water pressure produced by the pump to be adjusted, while a check valve 77 prevents backup. A pump discharge pipe 78 feeds into a header 79 for supplying the respective heat exchangers $E_1$, $E_2$ and $E_3$ with heated water or alternatively, chilled water. The inlet and outlet flows of each heat exchanger are controlled by valves 80 and 81, respectively. The heat exchangers each contain a coil 36, with air being passed through the heat exchangers, in the direction of arrow 82. The heat exchangers $E_1$, $E_2$ and $E_3$ may normally be placed at different or remote locations, as in such a position that the air discharged from each may pass directly or nearly directly into the room or other area to be heated or cooled. Any of the heat exchangers $E_1$, $E_2$ or $E_3$ thus may be placed in a separate space designed for it, in a wall, above a false ceiling, or even on a roof. Particularly when installed on a roof top, or in any other position where a heat exchanger $E_1$, $E_2$ or $E_3$ may be exposed to freezing temperatures, the coils of the heat exchanger should be provided with a drain valve responsive to a thermostat located just outside the heat exchanger. This thermostat is set to cause the drain valve to open, as when a temperature of 32°, for instance, is reached. The return flow from the heat exchangers is to a header 83, then through a pipe 84 and thence through the respective return pipes 37 and 31, except that a surge tank 85 is placed in the return line 37 to heat exchanger E, to accommodate a surge of water when heat is changed to or initiated. The water bath in chiller C acts as a surge tank in similar circumstances. Suitable blowers, conventional in nature, for moving the air through the heat exchanger E and the chiller C may be placed in the exhaust duct 64, while blowers for moving air through heat exchangers $E_1$, $E_2$ and $E_3$ are conveniently placed at the intake, so as to push air through the heat exchangers.

It will be noted that the heat exchanger E, when in use, not only provides heated water or fluid to heat cold makeup air, but also cools the exhaust gases from the cooking equipment, thereby reducing or perhaps eliminating the heat pollution effect of the kitchen exhaust system. The chiller C also has the dual function of not only providing chilled water for cooling hot makeup air, but also cooling the exhaust kitchen air, thereby again reducing the heat pollution effects thereof. In conjunction with the apparatus of FIG. 5, there should be an integrated air transfer system which includes a number of strategically located fans to move the air in a building, for instance, from one area to another for the purpose of pressure balancing the entire building.

The heating and cooling control valves, i.e. valves 68, 69 and 70, 71, may be solenoid valves, as indicated, so as to be controllable by a thermostat responsive to the need for heating, or cooling, as the case may be. Thus, valves 68 and 69 will be opened, as well as pump 74 started, when there is a need for heating recognized by the thermostat. When the need for heating no longer exists, the pump 74 is stopped and the valves 68, 69 closed. Similarly, when there is a need for cooling, valves 70 and 71 are automatically opened and pump 74 started, with closing and stopping, respectively, when there is no longer a need for cooling. It will be noted that a special heat transfer fluid may be pumped through heat exchanger E, but in view of the probability, at the start and stop of the respective cycles, of its becoming mixed with water from the chiller C, water is preferred as the heat exchange liquid for heat exchanger E. In the event of very high or very low outside temperatures, the heating or cooling may be supplemented by heaters or refrigeration coolers.

The diagram of FIG. 6 is similar to the diagram of FIG. 5, with corresponding parts having the same reference numerals. One difference is in furnishing either heating or cooling, alternatively, to any of the heat exchangers $E_1$, $E_2$ or $E_3$, individually, rather than as a group. Thus, heated water pipe 38 connects with inlet pipe 75 for pump 74, without any cooled water being supplied, so that pump 74 supplies, through pump outlet pipe 78, a distributing pipe 79' for heated water alone, from which heated water may be supplied to any one or more heat exchangers $E_1$, $E_2$ or $E_3$ by opening the respective inlet valve 80 thereof. Pump 74 may be running at the time, or then started, if the inlet valve 80 is the first to be opened. At the same time, the corresponding outlet valve 81 is opened for return of the previously heated water, after circulation through the corresponding heat exchanger, to a header 83', from which the return flow is led by pipe 84 through surge tank 85 and then through inlet pipe 37, back to the coil of the heat exchanger E. The cooled water pipe 30, leading from chiller C', extends to an inlet pipe 75' for a pump 74'. Bypass valves 76 and 76' and check valves 77 and 77' perform the same function for pumps 74 and 74', respectively, as bypass valve 76 and check valve 77 of FIG. 5. Pump 74' supplies cooling water to a pump outlet pipe 78', in turn connected to a cooled water distributing pipe 83, from which cooling water may be supplied to one or more selected heat exchangers $E_1$, $E_2$ or $E_3$ by opening the inlet valve 80' therefor, with pump 74' being started as the first valve 80' is opened or continuing to run if another valve 80' is open. The corresponding outlet valve 81' is opened to return the water, after circulation through the coil of the corresponding heat exchanger, to a header 88 connected to a return pipe 84' which, as before, connects with chiller return pipe 31. The valves 68 to 72 function as described previously.

In FIG. 6, an alternative manner of returning to the chiller C' the water previously circulated to one or more of the heat exchangers $E_1$, $E_2$ or $E_3$, including changes in the baffle construction of the chiller, is also illustrated. Thus, the chiller includes a bottom plate 11', spaced upright walls 18 and 18' over which the air is forced to flow, by baffles 19 and 19', into engagement with a water bath between walls 18 and 18' on bottom 11, similarly to the chiller C of FIG. 3. Also, the air flows under the lower lips of depending flanges 20 and 20', as before, but the center baffle 24 of FIG. 3 is omitted. Thus, after churning the water bath and producing evaporation for cooling, the air passes to each side, beneath transverse baffle 27 and over each corner between a baffle 19 or 19' and the corresponding flange 20 or 20°. In addition, instead of being returned into the water bath by pipe 31, as in the case of chiller C of FIG. 3, the return flow from the heat exchangers $E_1$, $E_2$ or $E_3$ passes from pipe 31 into a pipe 89 which connects with a longitudinal manifold 90 extending centrally atop baffle 27. A spaced series of nozzles 91, having a 90° turn and adapted to produce a horizontal, fan-shaped spray longitudinally of the beneath baffle 27, are connected to manifold 90 through baffle 27, as in FIG. 7. The laterally spreading sprays from nozzles 91 impinge against depending flanges 92, at each edge of baffle 27, and the water so impinging against the flanges drips or falls downwardly from the lower edges of a lower inwardly slanting lip 93 of each flange 92. The water so dripping or falling forms, in effect, a thin curtain of water through which the air or gas passes for evaporation of some of the water and further cooling of the remaining water. A series of nozzles 91 are preferably mounted to direct sprays from the area of outlet duct 64, in opposite directions toward the end of the chiller, to avoid the production of a water curtain effect at the position of the duct and reduce the amount of water which might be entrained in the air and discharged into the atmosphere.

Such additional evaporation of water from the curtains is of advantage when the wet bulb temperature of the air is not reached through agitation of the water bath and maximum cooling is desired. A portion of the water discharged by nozzles 91, such as directed centrally under the baffle 27, will, of course, fall toward the water bath without impinging against a flange 92, but the air passes upwardly from the water bath and will have an opportunity to engage this falling water to produce additional evaporation and cooling.

In use, the air passed through heat exchangers $E_1$, $E_2$ or $E_3$ may be only a portion of the air circulated to the area to which supplied, such as a room, since a portion of the air to the room may be untempered outside air. Normally, at least a portion of the incoming air should be outside air to maintain an adequate oxygen supply. There will be times when the outside temperature is such that the makeup air for one of more areas will need to be neither heated nor cooled. However, when heating is called for during severe weather conditions, such as approaching or below freezing, and the heat produced by the grease extraction ventilators is insufficient, supplemental heating may be utilized, such as bypassing a portion of the makeup air through a conventional air heating furnace, either outside makeup air or makeup air which has already passed through a heat exchanger $E_1$, $E_2$ or $E_3$. Or, a supplemental heater may add additional heat to the room or area by circulating air from the area through the supplemental heater and back to the area. The need for supplemental heating is occasioned when the outside air temperature during severe weather is below a temperature determined by the heat available from the heat exchange liquid at the heat exchange means involved. Similarly, supplemental cooling by mechanical refrigeration may be used during hot months at times when the outside temperature is sufficiently high that the cooling effect of the cooled water produced by the chiller C or C′ does not produce sufficient cooling of the makeup air. That is, the need for supplemental cooling is occasioned by the outside air temperature being above a temperature determined by the cooling available from the chilled water at the heat exchange means involved. Thus, either outside makeup air or makeup air which has already passed through a heat exchanger $E_1$, $E_2$ or $E_3$ may be cooled by a conventional mechanical refrigeration system. Or, supplemental refrigeration equipment may further cool the chilled water from the chiller, or may cool air circulated from the room. Such supplemental heating equipment may need to have only 40% of the capacity of that necessary for heating the areas without the waste heat recovery system of this invention, while the supplemental cooling equipment may need to have only 50% of the capacity of that necessary for cooling the areas without the cooling phase of the waste energy recovery system of this invention. It will be understood that each of the heat exchangers $E_1$, $E_2$ and $E_3$ may represent a plurality of individual heat exchangers, in a bank or row, and that more than three separately controlled areas may be supplied with heated or cooled makeup air.

One installation at a restaurant at Denver, Colorado, included two grease extraction ventilators, each with a series of heat exchangers E and a chiller corresponding to chiller C′ of FIG. 6, included in the system of ventilation, cooling and heating three public areas, separately controlled. These areas comprised a dining room along the south wall, a smaller bar behind the dining room and a coffee shop along the north wall, behind which was the kitchen and food preparation area. During a blizzard from the north, with the outside temperature below freezing, the heat exchangers E produced sufficient heat for makeup air for both the dining room and the bar room, while the coffee shop along the north wall required supplemental heating. In the case of another installation at Denver, Colorado, corresponding to FIG. 3, the gas consumption was reduced by 33% in the first full year of operation, as shown by utility company records, being 3.1 billion BTU for that year, compared with 4.6 billion BTU for the previous year and 4.3 billion BTU for the next previous year. The total energy used included that used for cooking, hot water and dishwashing, etc., these being unaffected by the involved system of this invention, as installed. It is estimated that the system of this invention furnishes approximately 80% of the heat required for heating the building and 50% of the energy required for cooling the building. The efficiency of the heat exchangers of my copending application Ser. No. 621,284, now U.S. Pat. No. 4,075,935 also contributed to the economies secured.

Although the utilization of waste energy from cooking equipment through air passed through a grease extraction ventilator has been illustrated and described and the utilization of waste energy from air taken above and below a dishwasher has been referred to, it will be evident that various other sources may be utilized. For instance, heat contained in heated air removed from the upper portion of a large room or enclosure, such as a theater, auditorium, meeting hall or the like, may be used to heat or preheat incoming makeup air, when the outside temperature is less than that to be maintained in the enclosure. When the outside temperature is greater than that to be maintained in the enclosure, air from the upper portion of the enclosure may be passed through a chiller to provide water for chilling makeup air in a separate heat exchanger.

Although different embodiments of this invention have been illustrated and described and certain variations thereof also described, it will be understood that other embodiments may exist and that various changes may be made, without departing from the spirit and scope of this invention.

What is claimed is:

1. A method of recovering waste energy from an exhaust gaseous source thereof, including heat, which includes:

causing movement of exhaust gas from said source through a heat exchanger to supply heat thereto;

moving a heat transfer liquid through said heat exchanger for heating said heat transfer liquid;

supplying water to a chiller having walls and baffle means for directing gas into engagement with a water bath for agitating the same and producing evaporation of water for cooling said water and said gas;

causing movement of said exhaust gas through said chiller and into engagement with said water bath;

passing makeup air for a room and the like through heat exchange means which includes a path for a heated or chilled liquid to heat or cool, alternatively, said makeup air;

circulating said heated heat transfer liquid through said heat exchange means; and alternatively circulating said chilled water from said chiller through said heat exchange means.

2. A method as defined in claim 1, wherein:

said source of waste energy comprises air carrying products of cooking from a cooking area and moved through a grease extraction ventilator.

3. A method as defined in claim 2, wherein:

said heat transfer liquid is water.

4. A method as defined in claim 3, including:

passing said exhaust air through water contact means of said grease extraction ventilator; and circulating water from said water contact means through said heat exchanger for precooling said exhaust air when cooling only is required.

5. A method as defined in claim 1, including:

returning said chilled water, after heat exchange, from said heat exchange means to said chiller by spraying above said water bath.

6. A method as defined in claim 5, including:

spraying at least a portion of said returned water to form essentially a curtain of falling water; and forcing at least said exhaust air to pass through said curtain.

7. A method as defined in claim 6, including:

providing spaced, parallel curtains of falling water above said water bath and forcing said exhaust air to move between said curtains to pass laterally through said curtains in opposite directions.

8. A method as defined in claim 1, including:

supplying makeup air for different areas to separate but corresponding heat exchange means;

circulating said heated heat transfer liquid through the heat exchange means whose corresponding areas require heating of said makeup air; and circulating said chilled water from said chiller through the heat exchange means whose corresponding areas require cooling of said makeup air.

9. A method as defined in claim 8, including:

supplying supplemental furnace heating to makeup or area air whose corresponding areas require heating of makeup air when the outside air is below a temperature determined by the heating available from said heat exchange liquid at the heat exchange means involved.

10. A method as defined in claim 8, including:

supplying supplemental cooling by refrigeration to makeup or area air whose corresponding areas require cooling of makeup air when the outside air is above a temperature determined by the cooling available from said chilled water at the heat exchange means involved.

11. A method as defined in claim 8, including:

making available heated heat exchange liquid to all of said separate heat exchange means simultaneously; and alternatively making available chilled water to all of said separate heat exchange means simultaneously.

12. A method as defined in claim 8, including:

making available heated heat exchange liquid and alternatively chilled water to said separate heat exchange means individually.

* * * * *